US005896974A

United States Patent [19]

Chang

[11] Patent Number: 5,896,974

[45] Date of Patent: Apr. 27, 1999

[54] PAPER MONEY EXCHANGER

[75] Inventor: Yuan Fong Chang, Taipei, Taiwan

[73] Assignee: Gamemax Corporation, Taipei, Taiwan

[21] Appl. No.: 08/888,203

[22] Filed: Jul. 7, 1997

[51] Int. Cl.[6] ..... G07F 7/04

[52] U.S. Cl. ..... 194/206; 194/350

[58] Field of Search ..... 194/206, 207, 194/350

[56] References Cited

U.S. PATENT DOCUMENTS 3,499,513 3/1970 Armstrong et al. ..... 194/206

FOREIGN PATENT DOCUMENTS 0113389 4/1990 Japan ..... 194/350

404299489 10/1992 Japan ..... 194/350

*Primary Examiner*—F. J. Bartuska

*Assistant Examiner*—Bryan Jaketic

*Attorney, Agent, or Firm*—Beveridge, DeGrandi, Weilacher & Young LLP

[57] ABSTRACT

A paper money exchanger of the type which comprises a housing which defines three receiving chambers for installing a paper money container, a circuit controlling device, a coins container, a coin guiding slot and a discharger is provided. The paper money collector fixedly attached to a moveable cover which is limited by a limiting tab for opening it within 90 degrees for maintenance and repair. The circuit controlling device, the coins container, the coin guiding slot and the coin discharger are moveably interconnected with a plurality of guiding rails, the stopping plates and threaded holes disposed within those three receiving chambers by a plurality of guiding rails, the stopping plates and threaded holes. A paper money exchanger can be readily configured by assembling those components.

1 Claim, 9 Drawing Sheets

PAPER MONEY EXCHANGER

FIELD OF THE INVENTION

The present invention relates to a paper money exchanger, more particularly, to a paper money exchanger in which a plurality of components are relatively arranged and disposed within a housing. By this arrangement, the input paper money can be readily exchanged to a plurality of coins which jointly equal to the face value of the input paper money.

DESCRIPTION OF PRIOR ART

The configuring components of a paper money exchanger shall be suitably arranged with respect to each other such that the coins bearing equivalent face value can be readily dispensed after the paper money is input. The arrangement and the assembling of the configuring components not only will influence the manufacturing cost of the paper money exchanger, but will also facilitate the smooth operation of the exchanger. For example, when a plurality of coins are disposed onto the coins rotating disk which is disposed above the coins discharger, the overall weight of the coins will impose an overload to the coins rotating disk. As a result, the exchanger may experience a coins jam as well as effect the accuracy of the sum of the face value of the coins. In light of this, if the overall weight of the coins is not suitably shifted to other configuring components from the coins rotating disk, the malfunction rate will increase and the efficiency will also be apparently decreased.

SUMMARY OF THE INVENTION

It is the objective of this invention to provide a paper money exchanger of the type which comprises a housing which defines three receiving chambers for installing a paper money container, a circuit controlling device, a coins container, a coin guiding slot and a discharger. Each of the configuring components are suitably arranged with respect to another configuring components such that the assembling time and the malfunction rate are decreased.

It is still the objective of this invention to provide a paper money exchanger which includes a housing having a first receiving chamber. The first receiving chamber is provided with a moveable cover for attaching a paper collector thereof such that the paper collector is provided with an opening freedom smaller than 90 degrees. The housing further includes a second receiving chamber in which a circuit controlling device is installed therein by means of guiding rails and stopping plates. A third receiving chamber is also defined and a coins container is disposed thereof. The coins container is provided with an opening which is aligned with an upper opening of a coin guiding slot. The lower opening of the coins guiding slot is inserted into the opening of the receiving slot of the coins discharger. The third receiving chamber is provided with guiding rails, stopping plate and threaded holes by which those three elements can be fixedly disposed within the third receiving chamber. With these configuring components, a paper money exchanger will be readily assembled. The housing is further provided with a moveable cover and a plurality of guiding rails, stopping plate and threaded holes for mounting those configuring components into the housing.

BRIEF DESCRIPTION OF THE DRAWINGS

In order that the present invention may more readily be understood the following description is given, merely by way of example with reference to the accompanying drawings, in which.

DETAILED DESCRIPTION OF PREFERABLE EMBODIMENT

Figure 1:
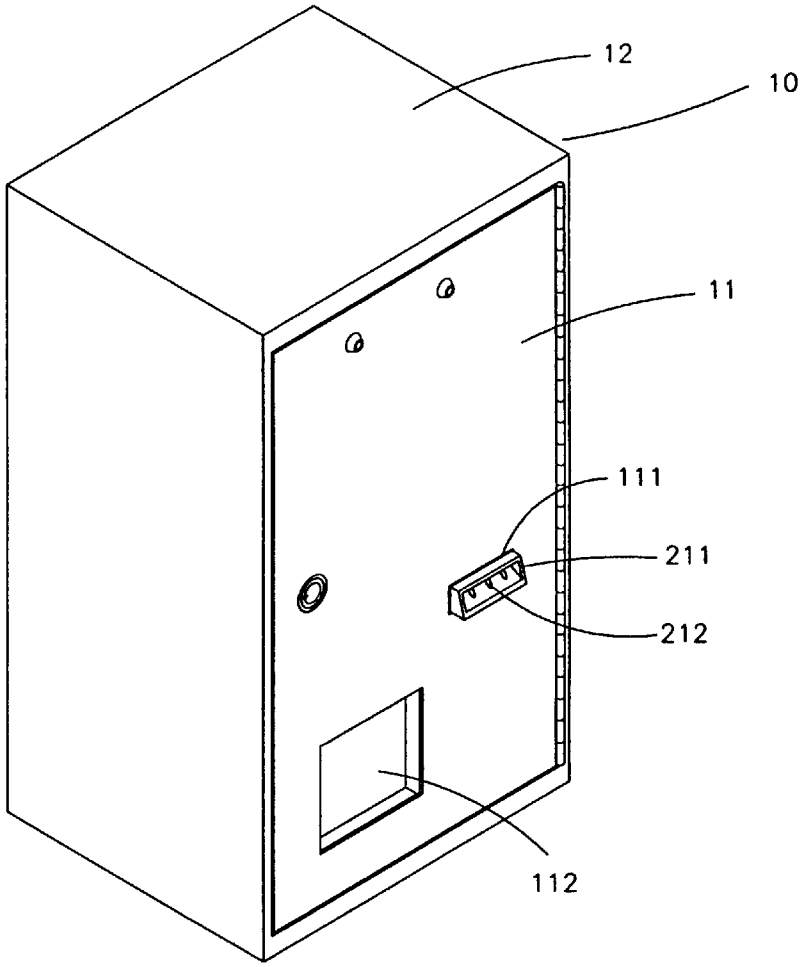
FIG. 1 is a perspective of the paper money exchanger made according to the present invention.
Figure 2:
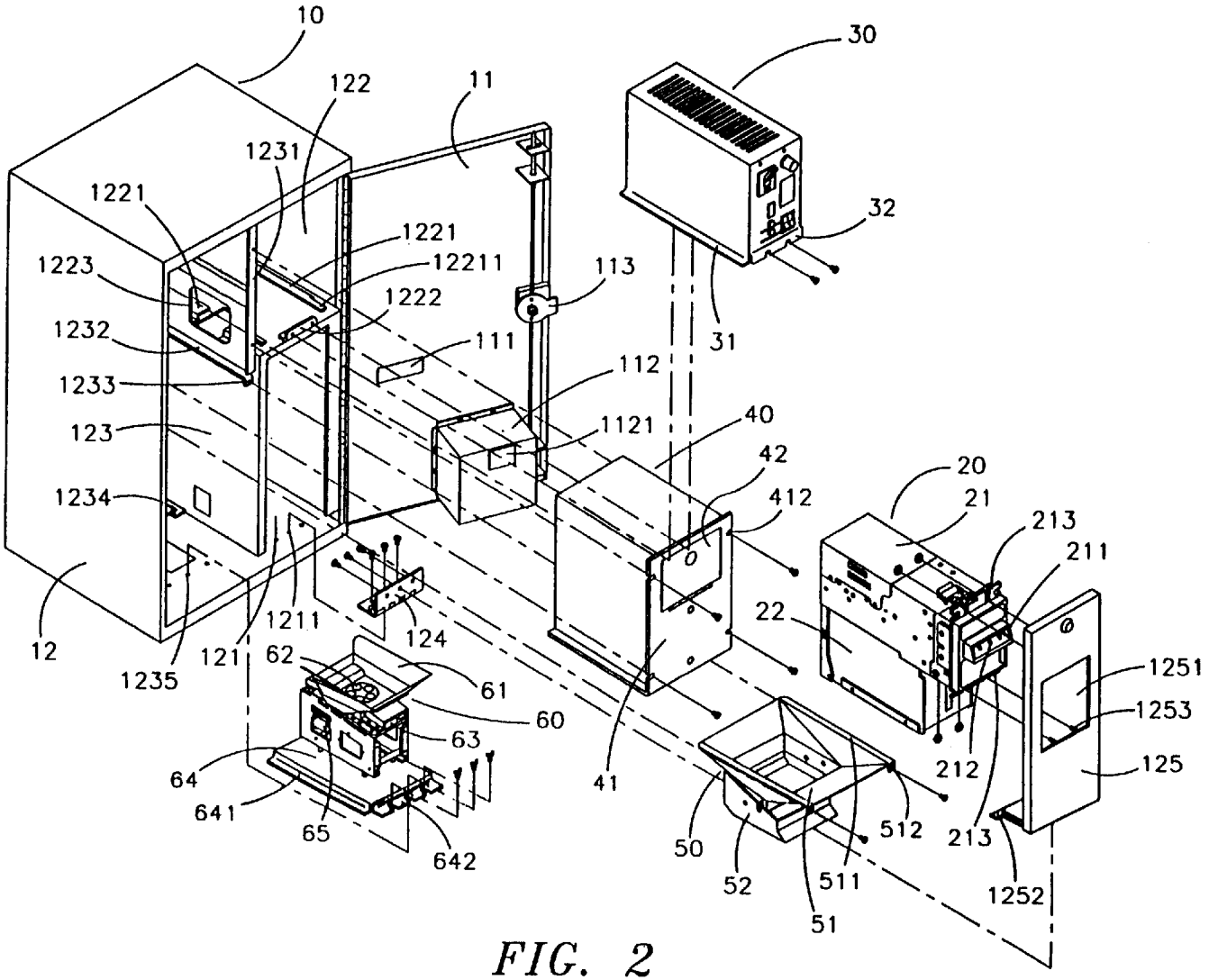
FIG. 2 is an exploded perspective view of the paper money exchanger made according to the present invention.

Referring to FIGS. 1 and 2, a perspective view and an exploded perspective view are respectively shown. The housing 10 is configured by a door plate 11 and a box 12. The door plate 11 is provided with a rectangular opening 111 which is designed such that the opening 111 is aligned with and corresponding to a inlet 211 of a paper money collector 20. The opening 111 is extended over the door plate 11. The coin outlet 112 is a collecting slot for hard money or coins which is provided with a coin inlet 1121 which is aligned with a coin outlet 63 of the coins discharger 60. The door plate 11 is further provided with a lock 113 such that the door plate 11 can be fixedly and removably attached to the box 12. The box 12 is divided into a first receiving chamber 121, a second receiving chamber 122 and a third receiving chamber 123 with the partitioning plates. The first receiving chamber 121 is provided with three threaded holes at the bottom and in which a hinge 124 can be fixedly attached thereof by means of locking screws. One of the leaves of the hinge 124 is fixedly attached to an inclined surface of a movable cover 125 which is provided with a limiting tab 1252 at both ends. The movable cover 125 is further provided with a rectangular positioning hole 1251 for receiving a panel of a collecting element 21 of the paper money collector 20. The rectangular positioning hole 1251 is further provided with two fixing studs 1253 which are disposed at upper and lower portions of the positioning hole 1251 respectively. By this arrangement, the stopping plate 213 having an opening thereon can be fixedly disposed on the fixing hole 1251 by means of locking nuts. The bottom sides of the second receiving chamber 122 is provided with a pair of guiding rails 1221. Each of the guiding rails 1221 is provided with a guiding plate 12211 which is directed upward and a L-shape stopping plate 1222 is disposed at the front central portion. The left side and the lower partitioning plate of the second receiving chamber 122 are provided with a through holes 1223 for directing the signal wires of the circuit controlling device 30 into the first receiving chamber 121 and the second receiving chamber 123 respectively. The upper portion and both sides of the third receiving chamber 123 are provided with stopping plates 1231 and each of the stopping plates 1231 is provided with a pair of threaded holes. By this arrangement, the stopping plates 1231 can be fixedly attached to mounting holes 412 disposed at both sides of the panel 41 of the coins container 40 by means of locking screws. The lower portion of those two stopping plates 1231 are further provided with a pair of guiding rails 1232 disposed at the side panel. The front portion of each of the guiding rails 1232 is provided with a bending tip which is provided with a pair of threaded holes 1233. By this arrangement, after the sliding element 511 of the wings of the receiving portion 51 of the coin guiding slot 50 is movable into the guiding rails 1232, those two threaded holes 512 can be used to attach the sliding element 511 thereof by means of locking screws. The bottom and the left and right sides are provided with a pair of guiding rails 1234 which are provided with three threaded holes 1235 in the front central portion. By this arrangement, the sliding element 641 of the coin discharger 60 can be firstly and movably disposed into the guiding rails 1234 and is fixedly attached to the stopping plate 1231 with the fixing tabs 642 by means of locking screws.

Figure 3:
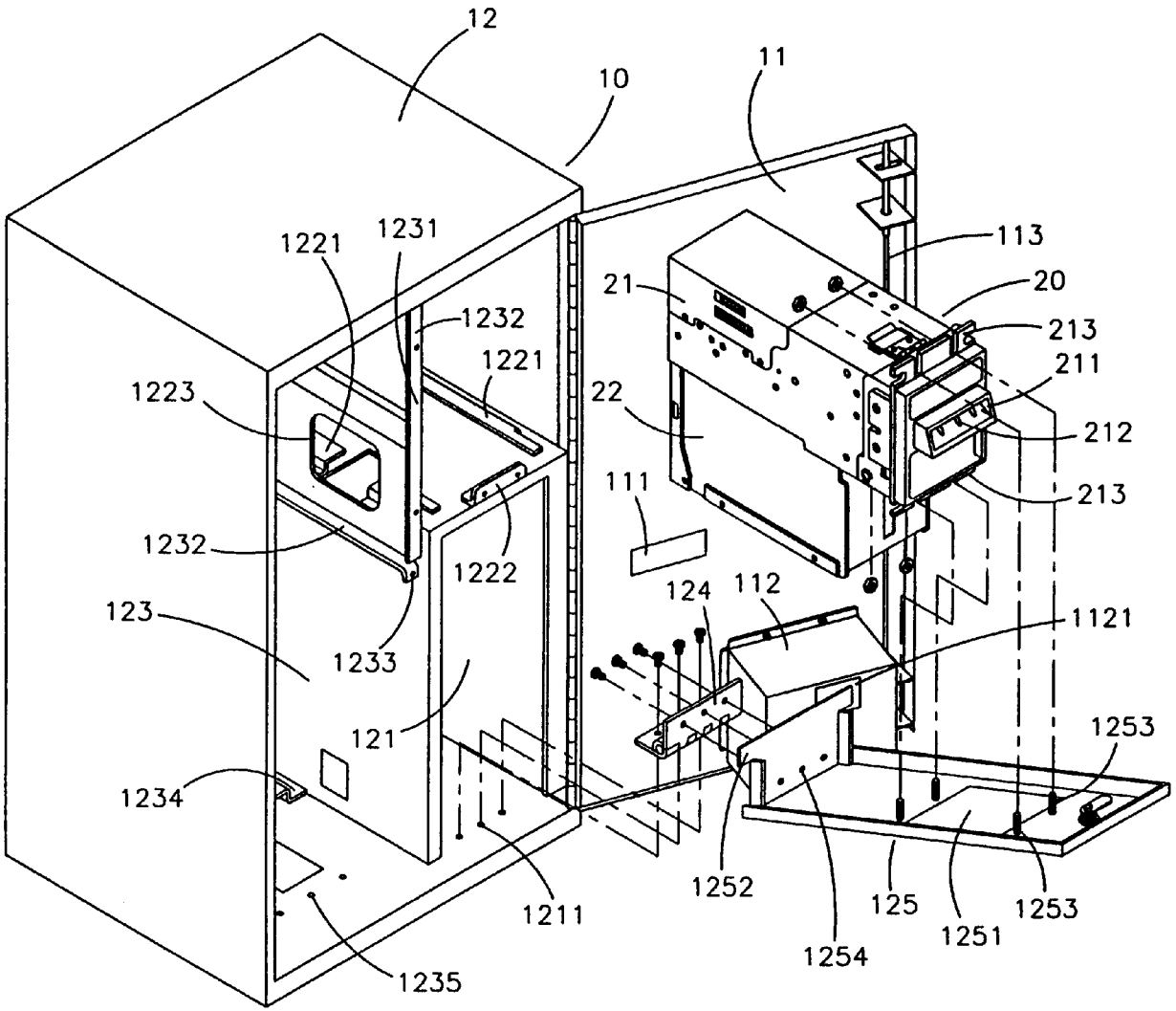
FIG. 3 is an exploded perspective view of the housing and the paper money collector made according to the present invention.
Figure 4:
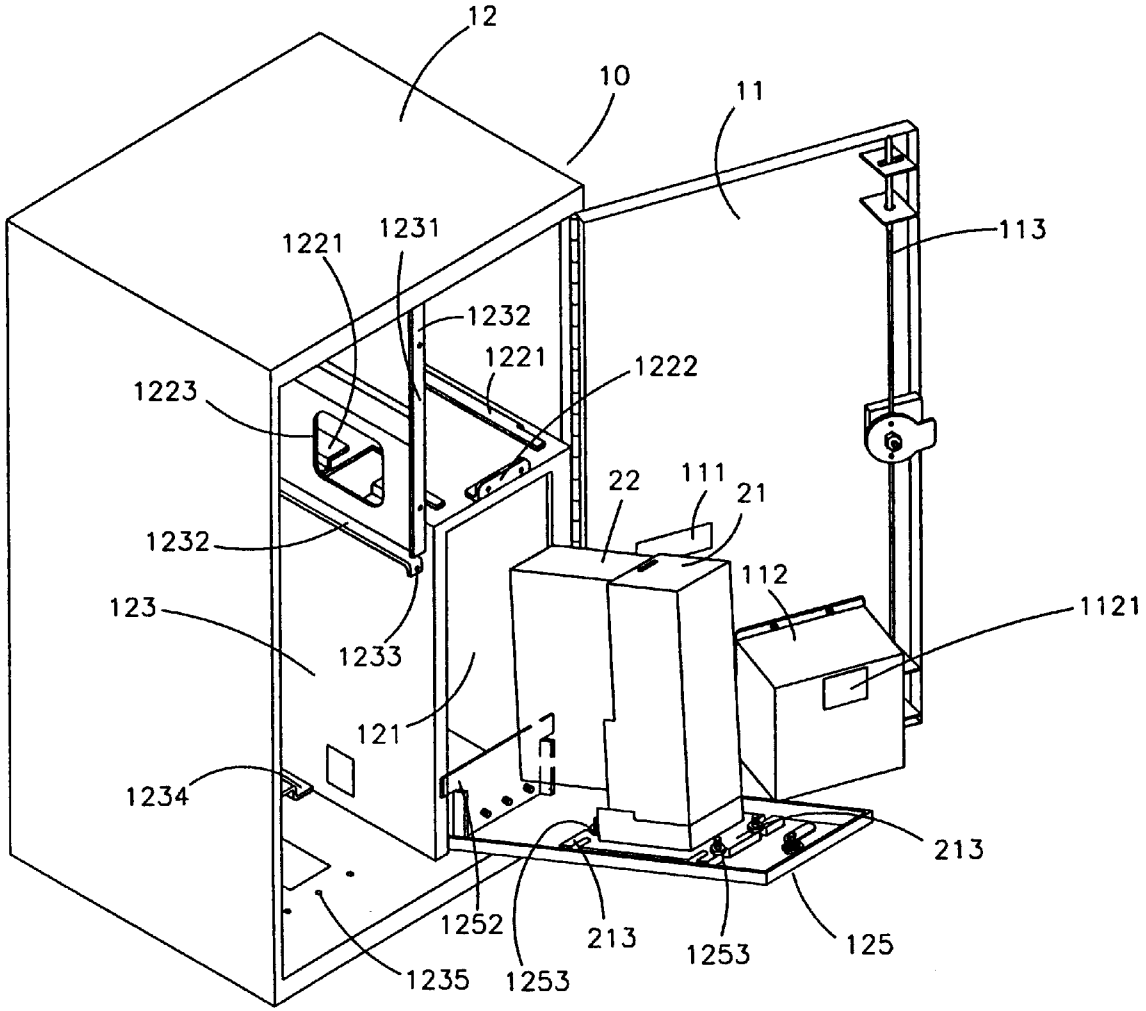
FIG. 4 is a perspective view the housing and the paper money collector made according to the present invention.

Referring to FIGS. 3 and 4, the paper money collector 20 is configured by a collecting element 21 and the paper money container 22. The collecting element 21 is provided with a rectangular inlet 211 for paper money. Three LED displays 212 are disposed under the lower channel and which are used to indicate the operation of the money exchanger in the dim area. The LED 212 is also used to indicate the operation of the circuit controlling device 30. Each of the end surfaces is provided with a stopping plate 213 which is provided with a plurality of openings for receiving the fixing studs 1253 of the moveable cover 125. A plurality of locking nuts can be locked the moveable cover 125 thereof. The paper money container 22 is disposed thereof for readily operation of the collecting element 21.

Figure 5:
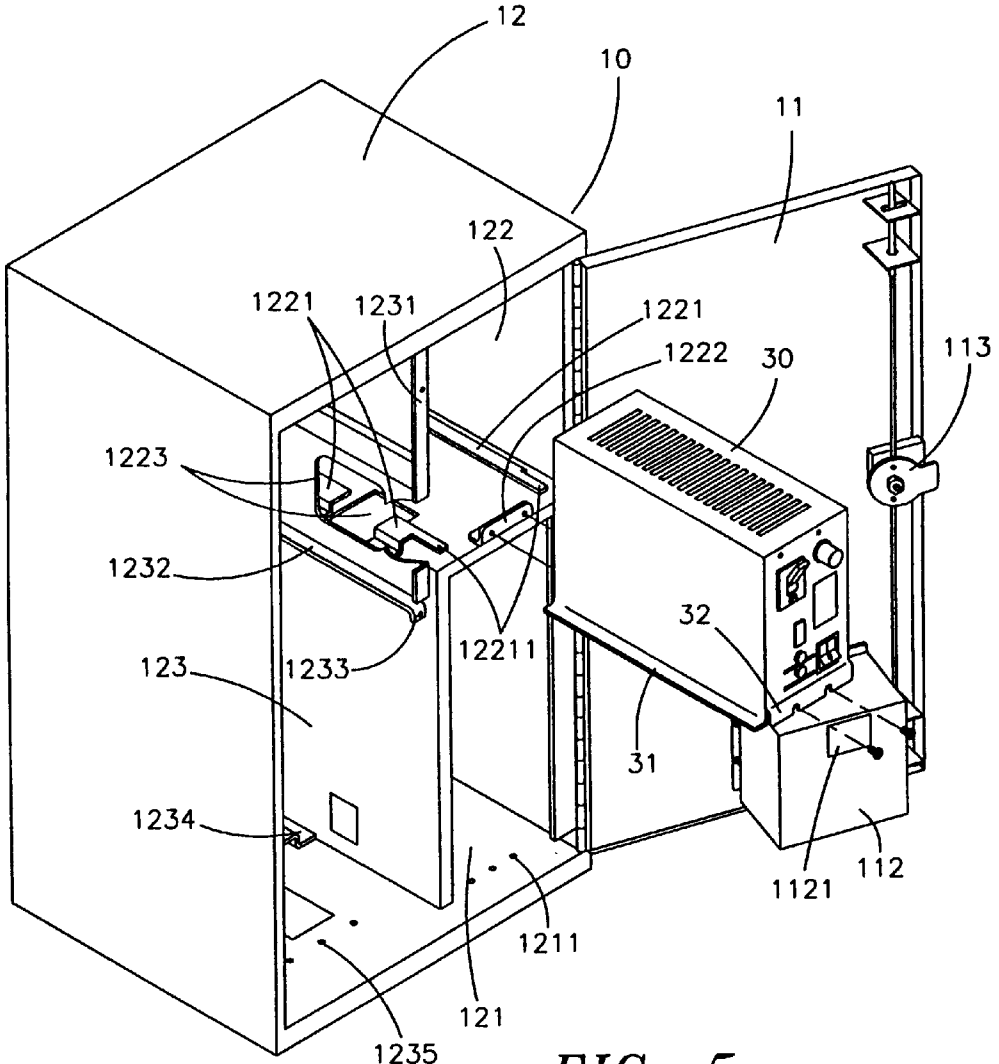
FIG. 5 is an exploded perspective view of the housing and the circuit controlling device made according to the present invention.

Referring to FIG. 5, when the paper money is inserted into the inlet 211, the circuit controlling device 30 is triggered on by the collecting element 21 and the denomination or face value will be recognized and this information will be transmitted to the circuit controlling device 30 by signal transmitting wires. The circuit controlling device 30 will further transmit the processed information to the coin discharger 60 to discharge the coins equal to the face value of the paper money. This has nothing to do with the present invention and no detailed description is given. A pair of guiding rails 31 are disposed under the circuit controlling device 30. As a result, after the guiding rails 1221 of the second receiving chamber 122 is moveably inserted, the second receiving chamber 122 can be fixed by fixedly connecting the stopping plate 2 and the stopping plate 1222 of the second receiving chamber 122.

Figure 6:
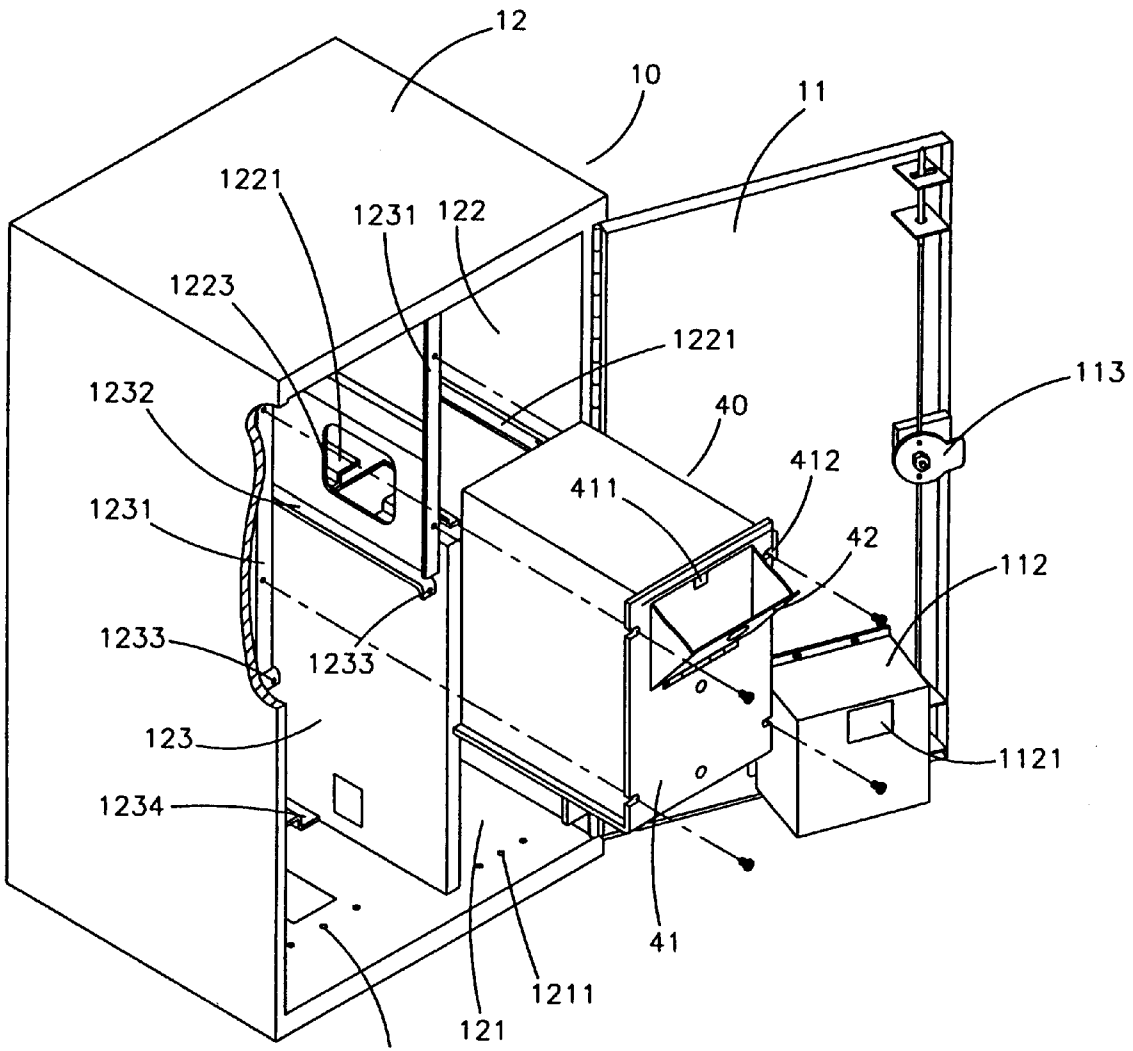
FIG. 6 is an exploded perspective view of the housing and hard money collecting container made according to the present invention.
Figure 7:
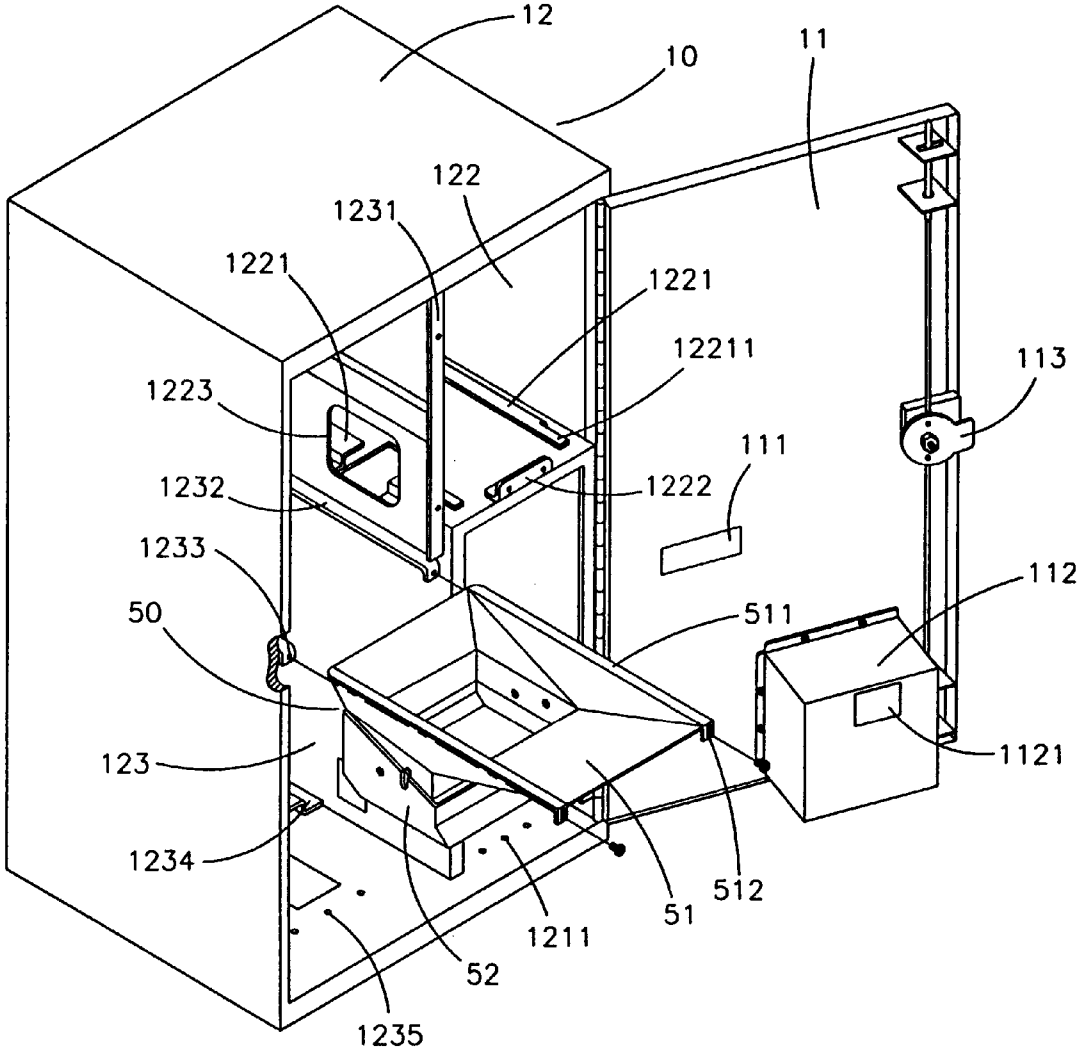
FIG. 7 is an exploded perspective view of the housing and hard money collecting slot made according to the present invention.

Referring to FIG. 6, the front panel 41 of the coins collector 40 is provided with an opening which is extended with a stopping tab 411 in the upper portion. A coin inserting slot 42 is installed at the stopping tab 411. The coin inserting slot 42 is further attached to a front panel 41 by means of a hinge. Consequently, the coin inserting slot 42 can be pivotally pulled outward. Both sides of the panel 41 are provided with four fixing holes 412 and by which the coins container 40 can be fixedly attached to threaded holes of the stopping plate 1231 of the third receiving chamber 123. Referring to FIG. 7, the receiving portion 51 of the coin guiding slot 50 is identical to a bore which is disposed at the lower portion of the coins container 40. Both sides of the receiving portion 51 are extended with a pair of guiding rails 511 which has a bending tip directed downward. This bending tip is provided with threaded holes 512. With the guiding rails 1232 and the stopping plate 1231 of the third receiving chamber 123, the guiding rails 511 can be moveably moved in and a pair of locking screws can be used to lock in the threaded holes 512, 1233. The lower portion of the coin guiding slot 50 is provided with a passage 52.

Figure 8:
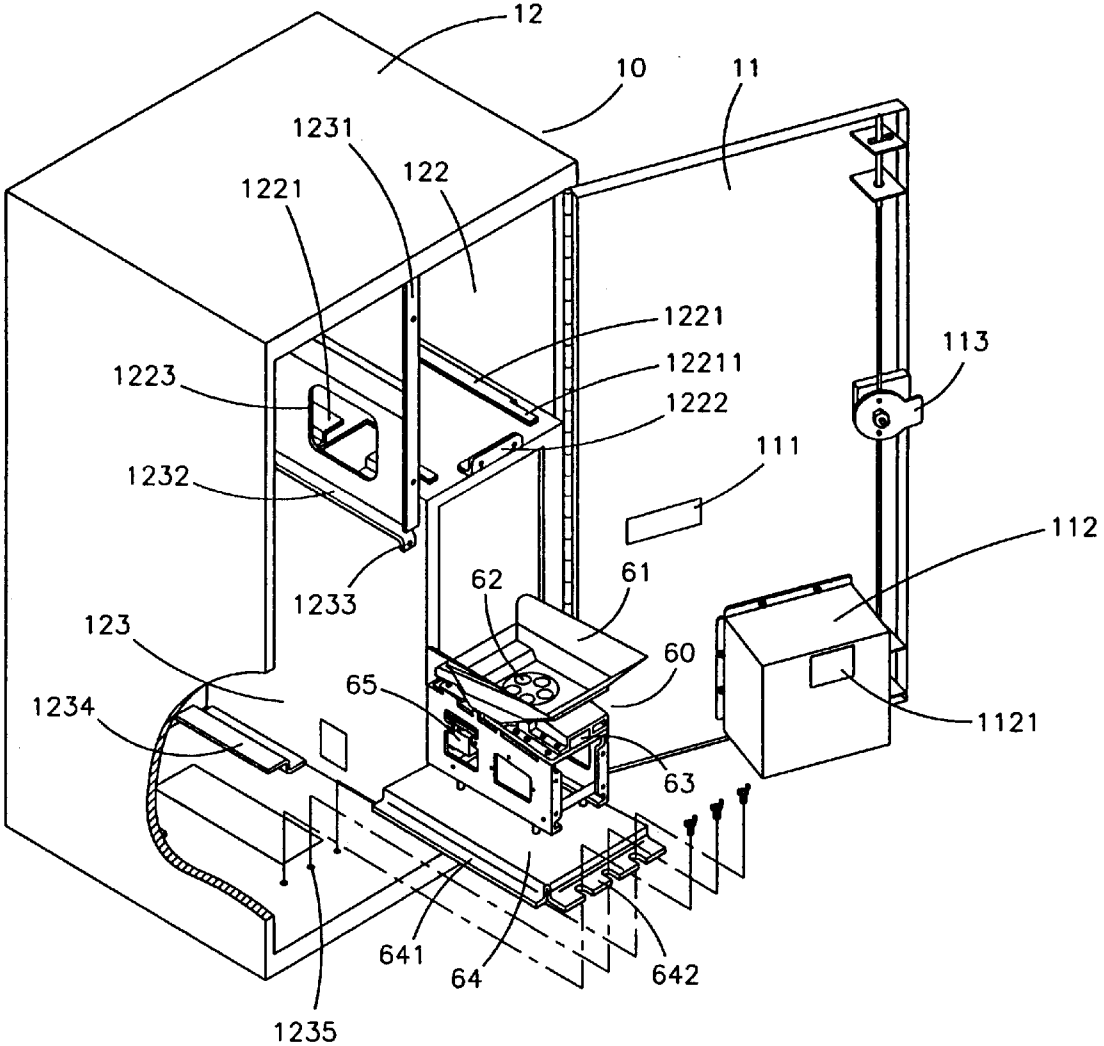
FIG. 8 is an exploded perspective view of the housing and the hard money discharging slot.

Referring to FIG. 8, the receiving slot 61 of the coin discharger 60 is designed to correspond to the passage 52 of the coin guiding slot 50. The receiving slot 61 is provided with a coin rotating disk 62 which is used to eject the coin out of the outlet 63 in the front portion. The lower portion is provided with a controlling portion 65 having a servo motor and pertinent circuitry. Both sides of the bottom 64 are provided with a pair of sliding element 641 which are operable with the guiding rails 1234. A stopping plate 642 is disposed in the front portion. Three locking screws can be used to locked into the threaded holes 1235.

Figure 9:
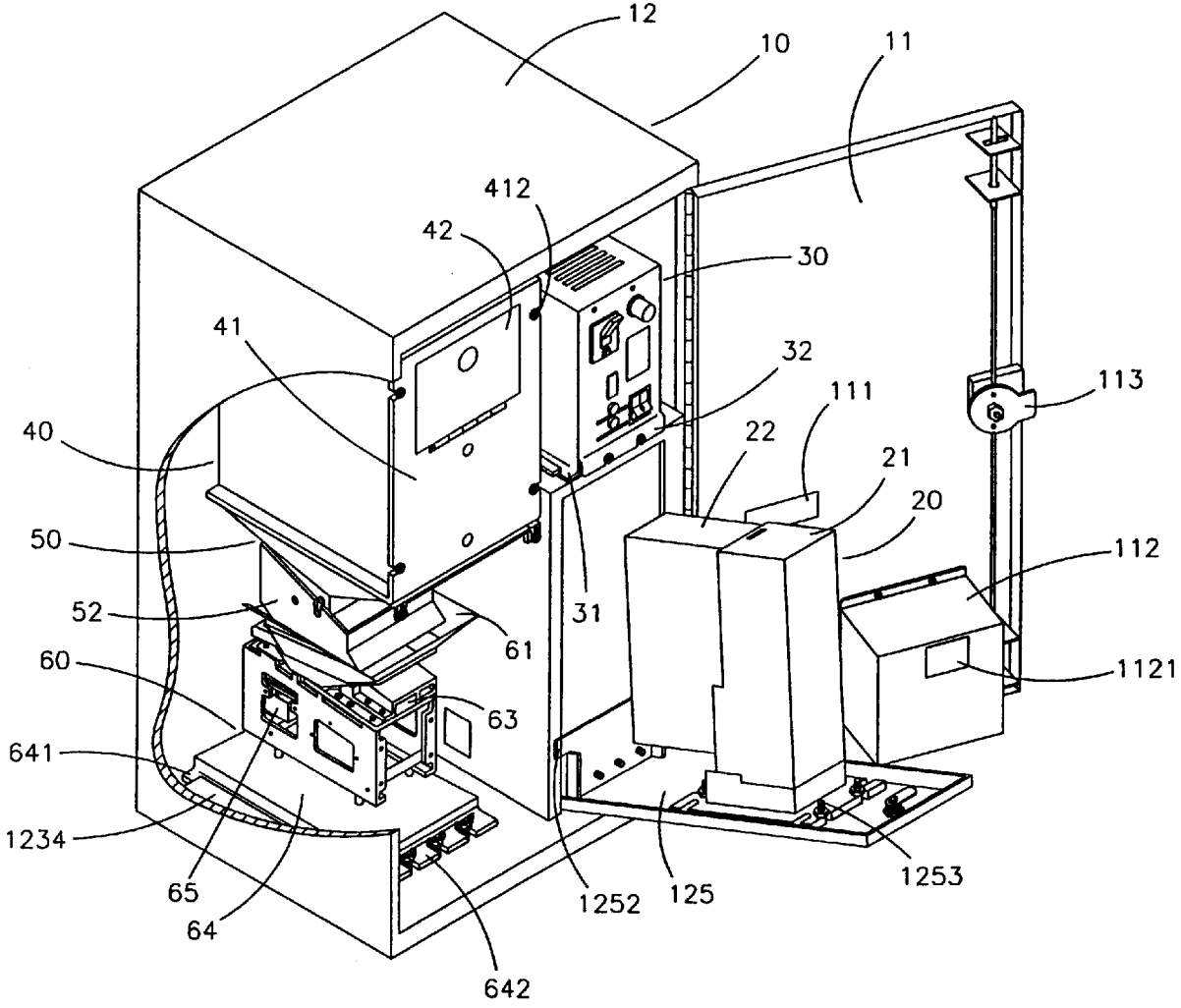
FIG. 9 is a perspective view of the paper money exchanger.

Referring to FIGS. 1 and 9, a brief description of the operation of the paper money exchanger will be merely described for reference. Firstly, the consumer may insert a paper money into the inlet 21 of the paper money collector 20 which is triggered to draw in the paper money which is finally disposed within the paper money container 22. After the paper money is received, the circuit controlling device will also be triggered and send out a signal to the controlling portion 65 of the coin discharger 60 which will be triggered accordingly and eject the coins equal to the face value of the paper money from the outlet 63. Those ejected coins will be discharged from the coin outlet slot 112 and the user may pick them up for future application.

Referring to FIG. 9, the third receiving chamber 123 is provided with the coins container 40, the coins guiding slot 50 and the coins discharger 60. Those components are suitably arranged such that the pressure exerted onto the coin rotating disk 62 can be effectively released. When the coins need to top up, the coins can be directly dropped into the coins inserting slot 42 and the coins will in turn fall into the receiving portion 51 of the coin guiding slot 50. The receiving portion 51 has a hoop configuration and is connected with a small passage 52 in the lower portion. The lower edge of the passage 52 is smaller than the upper edge of the receiving slot 61 of the discharger 60 and the receiving slot 61 is also configured with a hoop shape. With this primary and secondary turning surfaces, a buffering space is provided for the coin when it falls. Besides, when a plurality of coins are overlapped together, a buffering surface can be readily formed by the receiving portion 51 of the coins guiding slot 50 and the receiving slot 61 of the coins discharger 60. As a result, the pressure exerted onto the coin rotating disk 62 disposed above the coins discharger 60 can be suitably released. As a result, the coins can be readily supplied without the possibility of malfunction.

From the forgoing description, the paper money exchanger can be readily assembled and installed. With the reduced components, the malfunction rate is also reduced.

While particular embodiment of the present invention has been illustrated and described, it would be obvious to those skilled in the art that various other changes and modifications can be made without departing from the spirit and scope of the invention. It is therefore intended to cover in the appended claim all such changes and modifications that are within the scope of the present invention.

I claim:

1. A paper money exchanger of the type which comprises a housing which defines three receiving chambers for installing a paper money container, a circuit controlling device, a coins container, a coin guiding slot and a discharger, wherein said housing is configured by a door plate and a box, said door plate being provided with a rectangular opening and the back surface of said door plate being provided with an outlet having a coin ejector thereof, said door plate being further provided with a lock such that said door plate can be fixedly and removably attached to said box, said box being divided into a first receiving chamber, a second receiving chamber and a third receiving chamber, said first receiving chamber being provided with three threaded holes at the bottom and in which one leaf of a hinge being fixedly attached thereof with by means of locking screws, the other leaf of said hinge being fixedly attached to an inclined surface of a movable cover which is provided with a limiting tab at both ends, said movable cover being provided with a rectangular positioning hole which is further provided with two fixing studs disposed at upper and lower portions, the bottom sides of said second receiving chamber being provided with a pair of guiding rails, each of said guiding rails being provided with a guiding plate which is directed upward and a L-shape stopping plate being disposed at the front central portion, the left side and the lower partitioning plate of said second receiving chamber being provided with a through holes, the upper portion and both sides of said third receiving chamber being provided with two elongate stopping plates and each of said stopping plates being provided with a pair of threaded holes, the lower portion of said two stopping plates being provided with a pair of guiding rails disposed at the side panels, the front portion of each of said guiding rails being provided with a bending tip which is provided with a pair of threaded holes, the bottom and the left and right sides being provided with a pair of guiding rails which are provided with three threaded holes in the front central portion;

said paper money collector being configured by a collecting element and a paper money container, said collecting element being provided with a rectangular inlet for paper money, three LED displays being disposed under said inlet, each of the end surfaces being provided with a stopping plate which is provided with a plurality of openings thereof;

said circuit controlling device being provided with an elongate guiding rail at both sides thereunder and each of said guiding rail being provided with a stopping plate;

said coins collector being configured with a container having an opening in the front surface, a stopping tab being provided in the upper portion, a coin inserting slot being pivotally installed at said stopping tab by a hinge, both sides of the panel being provided with four fixing holes;

said coin collecting slot being provided with a pair of guiding rails at upper portion, each of said guiding rails being provided with a bending tip which is directed downward and said bending tip being provided with to threaded holes, a rectangular passage being disposed thereunder;

said coin discharger being provided with a coin receiving slot and a coin rotating disk being disposed at bottom central portion, an ejecting outlet being disposed in front of said coin rotating disk, the lower portion is provided with a controlling portion, both sides of the bottom being provided with a pair of guiding rails and each of said guiding rails being provided with a stopping plate;

wherein by the assembling and arrangement of said components, the overall assembling labor hour can be reduced and the malfunction rate during the operation is also lowered.

* * * * *